US011313247B2

(12) United States Patent
Trebicki

(10) Patent No.: US 11,313,247 B2
(45) Date of Patent: Apr. 26, 2022

(54) TURBINE HOUSING

(71) Applicant: BorgWarner Inc., Auburn Hills, MI (US)

(72) Inventor: Pawel Kacper Trebicki, Mazowieckie (PL)

(73) Assignee: Borg Warner Inc., Auburn Hills, MI (US)

( * ) Notice: Subject to any disclaimer, the term of this patent is extended or adjusted under 35 U.S.C. 154(b) by 2 days.

(21) Appl. No.: 16/810,948

(22) Filed: Mar. 6, 2020

(65) Prior Publication Data

US 2020/0284162 A1 Sep. 10, 2020

(30) Foreign Application Priority Data

Mar. 8, 2019 (EP) ..... 19161638

(51) Int. Cl.
*F01D 25/14* (2006.01)
*F01D 25/24* (2006.01)

(52) U.S. Cl.
CPC ..... *F01D 25/14* (2013.01); *F01D 25/24* (2013.01); *F05D 2220/40* (2013.01); *F05D 2240/60* (2013.01)

(58) Field of Classification Search
CPC ..... F01D 25/14; F01D 25/24; F01D 25/26; F04D 29/40; F02C 6/12
See application file for complete search history.

(56) References Cited

U.S. PATENT DOCUMENTS

2012/0189433 A1* 7/2012 Baker ..... F01D 17/14 415/158
2019/0078508 A1* 3/2019 Yoshida ..... F02C 6/12

* cited by examiner

*Primary Examiner* — Christopher Verdier
*Assistant Examiner* — Cameron A Corday
(74) *Attorney, Agent, or Firm* — Howard & Howard Attorneys PLLC

(57) ABSTRACT

The invention relates to a turbine housing, in particular for a turbo charging assembly (2) within a combustion engine, wherein the turbine housing (10) accommodates a shaft (8) with a turbine wheel (6) which is adapted to deliver fluid from a volute (26) as a fluid intake through an inlet channel to an fluid outlet (24), wherein the volute (26) and the fluid outlet (24) are separated along an axial direction (12) by a hollow area (30), the hollow area (30) being formed between an inner wall section (32) and an out wall section (34) around the fluid outlet (24) and being located in the axial direction (12) from a cover plate (36) covering the inlet channel next to the turbine wheel (6) within the turbine housing (10).

13 Claims, 2 Drawing Sheets

TURBINE HOUSING

CROSS-REFERENCE TO RELATED APPLICATIONS

Figure 1:
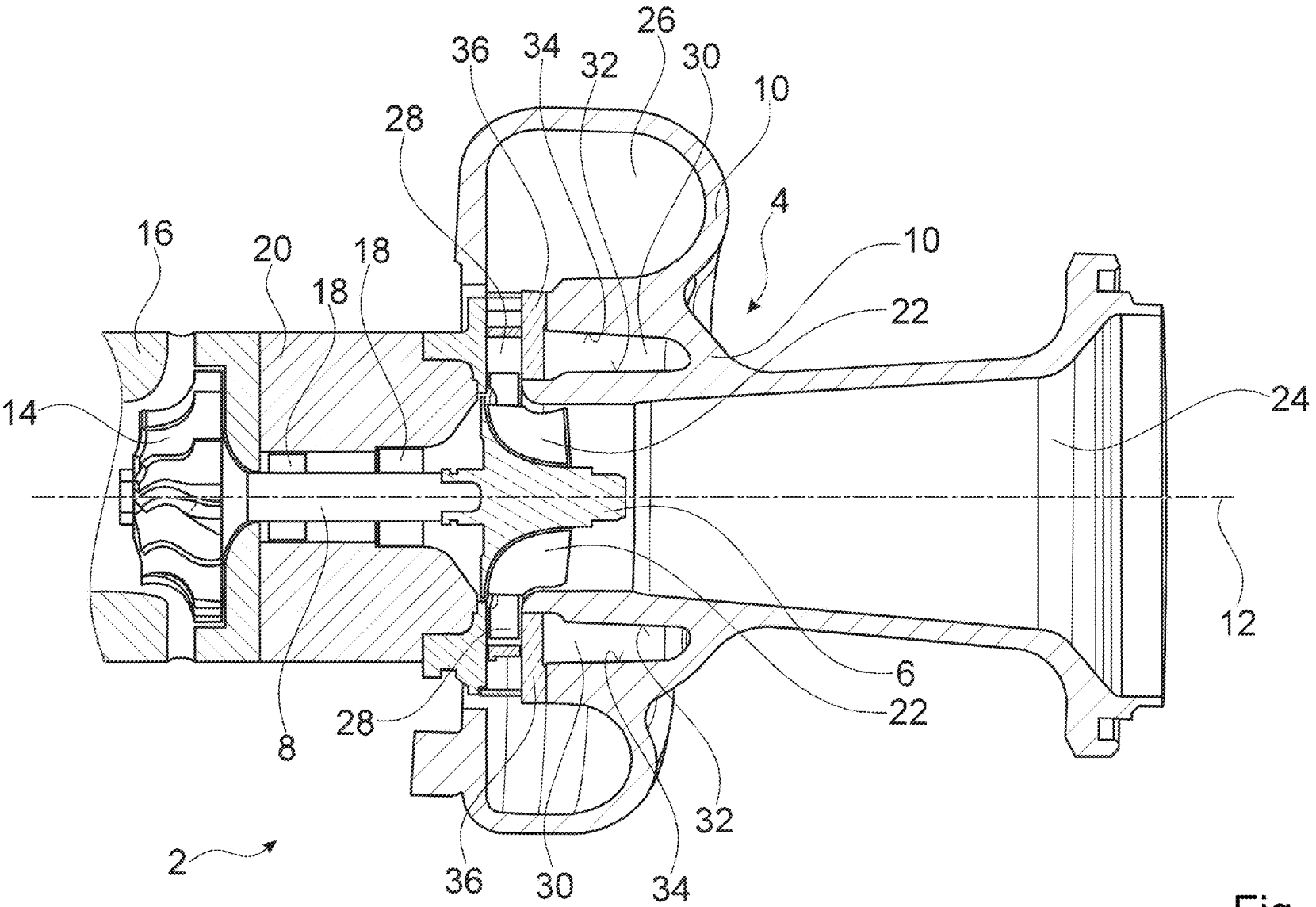

This application claims the benefit of EP Patent Application No. 19161638.2 filed on Mar. 8, 2019, the disclosure of which is herein incorporated by reference in its entirety.

This invention relates to a turbine housing, in particular to a turbine housing for a turbo charging assembly within a combustion engine.

Turbocharging devices are generally known which are intended for use as exhaust gas turbochargers in an internal combustion engine. Such devices are typically designed to supply air to an engine intake. For this purpose, a turbine housing is provided, which is arranged at an exhaust manifold of the internal combustion engine. A compressor housing is arranged in an intake manifold of the internal combustion engine, a bearing housing being connected to the turbine housing and the compressor housing. In the bearing housing a shaft is rotatably mounted, which connects a turbine wheel with the compressor wheel.

In order to form a variable turbine geometry (VTG) in an exhaust gas turbocharger, a vane assembly is provided which comprises pivoting vanes in the turbine housing to vary the passage of the exhaust gas into the turbine wheel. Unison pivoting of the vanes is typically achieved by means of an actuator connected to a unison plate and designed to control the angular alignment of all vanes simultaneously. It is however also possible that instead of rotating the vanes to vary the axial width of the inlet is selectively blocked by an axially sliding wall. The exhaust gas feed to the turbine casing is usually helical, with the feed channel being also referred to as a volute.

When the engine is started, e.g. the from a cold ambient temperature, the hot exhaust gases from the internal combustion engine will be directed towards the exhaust gas turbocharger and will pass the turbine housing and the turbine wheel. Accordingly, the turbine housing will start heating up, but this process will result in different thermal expansion rates at different positions within the turbine housing. In particular, temperature within the turbine housing can rise up to 1000° C. within approximately 20 seconds. The most crucial point is related to the thermal expansion of the turbine wheel. Different thermal expansion rates are accommodated by a so-called wheel gap between the turbine wheel and the turbine housing in order to ensure that the turbine wheel will not start wrapping at the turbine housing. Wheel gaps however reduce the overall performance of turbocharger and should therefore be kept as low as possible.

It is accordingly an object of the invention to provide a turbine housing, in particular for a turbo charging assembly within a combustion engine, which offers increased performance due to tighter wheel gaps This object is achieved by present claim 1 of the invention. Further advantageous embodiments of the invention are subject of the subclaims.

These can be combined in a technologically meaningful way. The description, in particular in connection with the drawing, characterizes and specifies the invention additionally.

According to the invention, a turbine housing, in particular for a turbo charging assembly within a combustion engine, is described, wherein the turbine housing accommodates a shaft with a turbine wheel which is adapted to deliver fluid from a volute as a fluid intake through an inlet channel to an fluid outlet, wherein the volute and the fluid outlet are separated along an axial direction by a hollow area, the hollow area being formed between an inner wall section and an outer wall section around the fluid outlet and being located in the axial direction from a cover plate covering the inlet channel next to the turbine wheel within the turbine housing.

The invention provides hollow area, which surrounds the fluid outlet along an axial direction. Accordingly, specific areas of the turbine housing, which are close to the blades of the turbine wheel, are altered with respect to their thermal expansion in order to allow smaller wheel gaps.

In particular, thermal expansion in the form of conical modes at the turbine wheel next to the fluid outlet has been found crucial.

Furthermore, the provision of the hollow areas reduces the overall thermal load of the turbine housing.

In addition, the hollow areas may also result in a stiffer turbine housing, so that weight reduction can be achieved or cheaper materials can be used for the turbine housing.

By introducing hollow areas into the turbine housing a controlled deformation can be achieved so as to achieve the above-mentioned objects. The hollow area is formed as a pocket, which starts in a plane next to the fluid inlet surrounding the turbine wheel. Usually this area accommodates vanes in order to achieve a variable turbine geometry. In order to separate the hollow area from the fluid inlet, a cover plate is provided so that the exhaust gases do not enter the hollow area. Instead of vanes another arrangement like shrouds or the like may be provided in that area.

According to an embodiment of the invention, the inner wall section and the outer wall section are arranged convergingly so as to close the hollow area opposite the cover plate.

While the inner wall section and the outer wall section next to the fluid inlet channel, which is covered by the cover plate, the wall sections can be formed along the axial direction such that the wall sections meet each other. Accordingly, no further cover is necessary in order to close the hollow area opposite the cover plate.

According to further embodiment of the invention, the inner wall section is formed with an increasing diameter with increasing distance to the turbine wheel along the axial direction. The outer wall section may be formed with a decreasing diameter with increasing distance to the turbine wheel along the axial direction. In particular, the hollow area can be formed such that the turbine housing can be casted.

This arrangement allows an implementation in a casted turbine housing, which greatly reduces costs when manufacturing such housing. Together with the reduced weight the invention allows to significantly decrease the overall costs of the turbine housing. Either steel cast or sand casting could be used.

According to further embodiment of the invention, the turbine housing together with the hollow area is formed as a single piece.

The hollow area and the other components within the turbine housing are formed in such a way that the turbine housing can be formed as a single piece.

According to further embodiment of the invention, the cover plate belongs to a variable turbine geometry arrangement covering rotatable vanes.

The cover plate can be part of a variable turbine geometry arrangement and in particular may also cover the rotatable vanes of the variable turbine geometry arrangement.

According to further embodiment of the invention, the fluid outlet is formed at least partially having a tube shape along the axial direction.

The fluid outlet surrounding the blades of the turbine wheel can be formed at least in this area which is covered by the hollow area as a tube along the axial direction, where the tube is provided with an increasing diameter with increasing distance to the turbine wheel. The fluid outlet can be formed symmetrically around the axial direction, although it is also conceivable that the fluid outlet is slightly bent along the axial direction.

According to further embodiment of the invention, the dimensions of the hollow area are selected so as to minimize heat deformation during heating up of the combustion engine.

With respect to heat deformation the dimensions of the hollow area are crucial. The overall aspects during heating up are usually investigated using proper software tools, in order to judge thermal expansion and the varying conditions. Various dimensions of the hollow area can be included into those simulations so as to minimize heat deformation of the turbine housing during the heating up of a combustion engine.

According to further embodiment of the invention, the hollow area extends in the axial direction beyond the turbine wheel.

It has been found that the hollow area should be formed a significant section along the axial direction though that it extends beyond the turbine wheel. In other words, deep pockets formed by the hollow area which affect the thermal performance of the turbine housing.

According to further embodiment of the invention, the hollow area is symmetrically formed around the axial direction, at least partially.

Above mentioned simulations revealed that a symmetrical arrangement of the hollow area positively affects the thermal performance of the turbine housing according to the invention. Small non-symmetrical areas are still considered not to destroy the overall symmetry, which will advantageously be selected as rotational symmetry around the axial direction.

Finally, an exhaust gas turbo charger having a turbine as outlined above is described.

Figure 2:
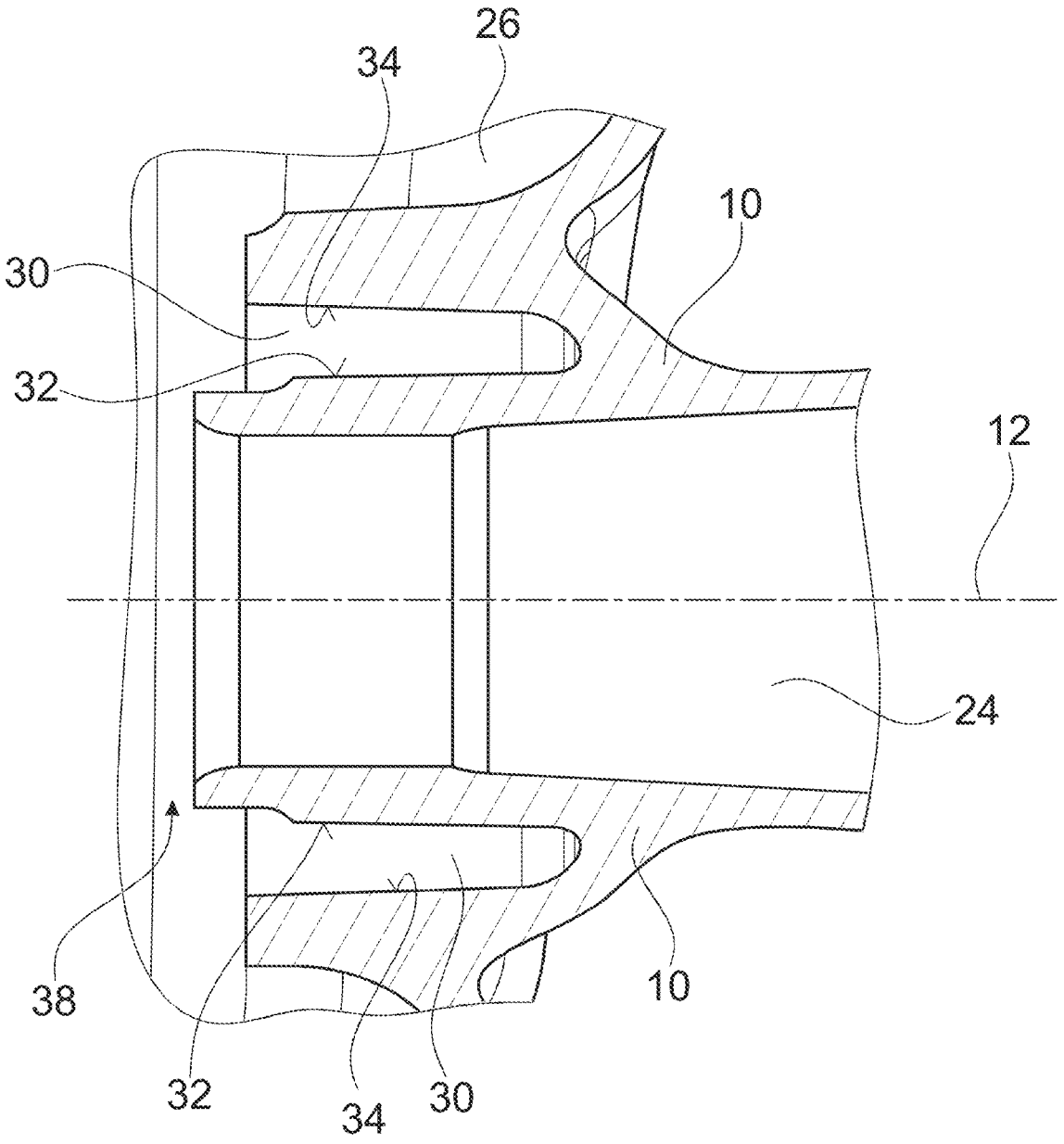

In the following, some examples of the invention are explained in more detail using the drawing, wherein:

FIG. 1 shows a cross-sectional view of an exhaust gas turbocharger in a cross-sectional view with a turbine arrangement according to the invention, and FIG. 2 a detail of the turbine arrangement according to FIG. 1 in a cross-sectional view.

In the figures, identical or functionally identical components are provided with the same reference symbols.

FIG. 1 shows an embodiment of the invention, wherein a turbo charging assembly 2 is shown in the cross-sectional view. The turbo charging assembly 2 comprises a turbine arrangement 4 including a turbine wheel 6 on a shaft 8 within a turbine housing 10. The shaft 8 is arranged along a longitudinal axis which defines an axial direction 12. On the opposite side of the shaft 8, a compressor wheel 14 is arranged within a compressor housing 16. The shaft 8 is guided by a plurality of bearings 18, which are arranged within the bearing housing 20. The turbine wheel 6 includes a number of blades 22 so that an exhaust gas from a fluid inlet rotates the turbine wheel 6 and consequently the compressor wheel 14 as well.

The exhaust gas exits the turbine arrangement 4 at a fluid outlet 24, which is arranged around the axial direction 12. The fluid inlet is typically formed as a volute 26, which is wrapped around the axial direction 12 so that the exhaust gas is guided towards the turbine wheel 6 radially inwardly. In a circumferential area between the volute 26 and the turbine wheel 6 a plurality of vanes 28 are arranged in order to form a variable turbine geometry. The vanes 28 can rotate around an axis parallel to the axial direction 12 in a unison manner so that the cross-section for exhaust gas between the volute 26 and the turbine wheel 6 can be altered.

When the combustion engine is started exhaust gas will heat up the turbine housing 10 and all the other associated parts of the turbine charging assembly 2 from the ambient temperature up to 1000° C. within approximately 20 seconds. Materials for the turbine housing 10 can be selected which withstand temperatures up to 1200° C. Accordingly, thermal expansion will take place at the various components of the turbine charging assembly 2 which is in particular critical in the region where the blades 22 of the turbine wheel 6 are spaced very narrowly to the turbine housing 10. In order to avoid rubbing of the turbine wheel 6 under different conditions a certain wheel gap is introduced between the turbine wheel 6 and the turbine housing 10.

In order to optimize the turbine housing 10 hollow area 30 is formed within the turbine housing 10. The hollow area 30 is formed between an inner wall section 32 and an outer wall section 34. The hollow area is formed as a circumferential channel around the axial direction 12. The hollow area is covered by a cover plate 36 which is arranged next to vanes 28 of the variable turbine geometry. Accordingly, no exhaust gases from the volute 26 can enter the hollow area 30. The inner wall section 32 and the outer wall section 34 are arranged convergingly in order to close the hollow area 30 opposite the cover plate 36. Along the axial direction 12 the hollow area 30 extends beyond the turbine wheel 6. The cover plate 36 is typically used as a part of the variable turbine geometry.

The hollow area 30 therefore forms deep pockets within the turbine housing 10 which can be arranged in such a way that heat deformation during heating up of the combustion engine is minimized. In addition, turbine housing 10 can be produced with less weight, with improved stiffness, or fabricated from less expensive materials. The lower thermal loads together with the controlled deformation of the turbine housing 10 can also increase the overall performance of the turbo charging assembly 2 by offering the possibility to use tighter wheel gaps between the turbine wheel 6 and the turbine housing 10.

Making no reference to FIG. 2 the turbine housing 10 is depicted more detailed, wherein for simplicity all other components of the turbo charging assembly 2 have been removed.

As can be seen from FIG. 2, turbine housing 10 can be fabricated as a single piece, preferably within the steel cast or sand casting manufacturing process. The fluid outlet 24 is shaped with increasing diameter along the axial direction 12, so that the turbine housing 10 exhibits a tube shape at least in those sections which are covered by the hollow area 30. The hollow area 30 is formed as deep pockets starting in an area which is usually covered by the variable turbine geometry arrangement. This area is indicated in FIG. 2 by reference numeral 38. The inner wall section 32 and the outer wall section 34 can be formed with slightly different diameters towards the fluid outlet 24 so that the 2 surfaces meet each other in order to close the hollow area 30 opposite the area 38.

The hollow area 30 can be formed such that it fully encloses the axial direction 12. The size of the hollow area 30, in particular the distance between the inner wall section 32 and the outer wall section 34 will be selected such that thermal loads are recused to the turbine housing 10. It should be noted that the presence of the hollow area 30 is prerequisite for allowing a tube shape of the turbine housing 10 at least in the area which is covered by the hollow area 30.

The above features and the features indicated in the claims as well as those which can be taken from the illustrations can be realized advantageously both individually and in various combinations. The invention is not limited to the exemplary embodiments described, but can be modified in many ways within the framework of the knowledge of a person skilled in the art.

LIST OF REFERENCES

2 turbo charging assembly
4 turbine arrangement
6 turbine wheel
8 shaft
10 turbine housing
12 axial direction
14 compressor wheel
16 compressor housing
18 bearings
20 bearing housing
22 blade
24 fluid outlet
26 volute
28 vane
30 hollow area
32 inner wall section
34 outer wall section
36 cover plate
38 area

The invention claimed is:

1. Turbine housing, for a turbo charging assembly (2) within a combustion engine, wherein the turbine housing (10) accommodates a shaft (8) with a turbine wheel (6) which is adapted to deliver fluid from a volute (26) as a fluid intake through an inlet channel to a fluid outlet (24), wherein the volute (26) and the fluid outlet (24) are separated along an axial direction (12) by a hollow area (30), the hollow area (30) being formed between an inner wall section (32) and an outer wall section (34) around the fluid outlet (24) and being located in the axial direction (12) from a cover plate (36) covering the inlet channel next to the turbine wheel (6) within the turbine housing (10), wherein the inner wall section (32) is formed with an increasing diameter with increasing distance to the turbine wheel (6) along the axial direction (12) and wherein the outer wall section (34) is formed with a decreasing diameter with increasing distance to the turbine wheel (6) along the axial direction (12), and wherein an edge of the cover plate (36) terminates at an inner surface of the inner wall section (32) directly adjacent the hollow area (30).

2. Turbine housing according to claim 1, wherein the inner wall section (32) and the outer wall section (34) are arranged convergingly so as to close the hollow area (30) opposite the cover plate (36).

3. Turbine housing according to claim 1, wherein the hollow area (30) is formed tube shaped.

4. Turbine housing according to claim 1, wherein the fluid outlet (24) is formed tube shaped at least where covered by the hollow area (30).

5. Turbine housing according to claim 1, wherein the hollow area (30) can be formed such that the hollow area (30) in the turbine housing (10) can be casted.

6. Turbine housing according to claim 1, wherein the dimensions of the hollow area (30) are selected so as to minimize heat deformation during heating up of the combustion engine.

7. Turbine housing according to claim 1, wherein the hollow area (30) extends in the axial direction beyond the turbine wheel (6).

8. Turbine housing according to claim 1, wherein the turbine housing (10) including the hollow area (30) is formed as a single piece.

9. Turbine housing according to claim 1, wherein the cover plate (36) belongs to a variable turbine arrangement covering variable vanes.

10. Turbine housing according to claim 1, wherein the hollow area (30) is at least partially formed symmetric around the axial direction (12).

11. Turbine housing according to claim 10, wherein the hollow area (30) is provided in a rotational symmetric form.

12. Turbine housing according to claim 1, which can withstand a temperature rise up to 1200° C.

13. An exhaust gas turbo charger having a turbine housing (10) according to claim 1.

* * * * *